US009920998B2

(12) United States Patent
Takahashi et al.

(10) Patent No.: US 9,920,998 B2
(45) Date of Patent: Mar. 20, 2018

(54) AIR COOLED CONDENSER AND POWER GENERATING APPARATUS PROVIDED WITH THE SAME

(71) Applicant: Fuji Electric Co., Ltd., Kawasaki-shi, Kanagawa (JP)

(72) Inventors: Kuniyuki Takahashi, Kanagawa (JP); Isamu Osawa, Kanagawa (JP)

(73) Assignee: Fuji Electric Co., ltd., Kawasaki-Shi, Kanagawa (JP)

( * ) Notice: Subject to any disclaimer, the term of this patent is extended or adjusted under 35 U.S.C. 154(b) by 118 days.

(21) Appl. No.: 14/350,961

(22) PCT Filed: Jan. 23, 2013

(86) PCT No.: PCT/JP2013/000308
§ 371 (c)(1),
(2) Date: Apr. 10, 2014

(87) PCT Pub. No.: WO2013/111577
PCT Pub. Date: Aug. 1, 2013

(65) Prior Publication Data

US 2014/0250890 A1 Sep. 11, 2014

(30) Foreign Application Priority Data

Jan. 23, 2012 (JP) ..... 2012-010698

(51) Int. Cl.
*F01K 9/00* (2006.01)
*F28D 1/00* (2006.01)
(Continued)

(52) U.S. Cl.
CPC ..... *F28D 1/00* (2013.01); *F01K 7/16* (2013.01); *F01K 9/00* (2013.01); *F01K 9/003* (2013.01);
(Continued)

(58) Field of Classification Search
CPC ..... F28B 1/06; F28B 11/00; F28B 9/10; F28F 27/00; F28F 27/02; F01K 9/00;
(Continued)

(56) References Cited

U.S. PATENT DOCUMENTS 3,289,742 A * 12/1966 Niemann ..... F28B 1/06 165/111
3,703,809 A * 11/1972 Cassidy ..... B01D 5/0009 165/110
(Continued)

FOREIGN PATENT DOCUMENTS

JP S63-201492 A 8/1988
JP 0678868 B2 * 10/1994
(Continued)

*Primary Examiner* — Mark Laurenzi
*Assistant Examiner* — Xiaoting Hu
(74) *Attorney, Agent, or Firm* — Young Basile Hanlon & MacFarlane, P.C.

(57) ABSTRACT

Disclosed are an air cooled condenser capable of preventing air from being mixed into a working medium flow path, and a power generating apparatus including the air cooled condenser. The air cooled condenser includes a heat exchanger for air-cooling a working medium indirectly through a wall, a fan, a sensor for measuring a pressure value of the working medium at an outlet of the heat exchanger, and a controller for controlling the rotating speed of the fan such that the pressure value obtained by the sensor comes closer to a target value set to be equal to or larger than an atmospheric pressure.

7 Claims, 7 Drawing Sheets

(51) Int. Cl.

| | |
|---|---|
| ***F28B 1/06*** | (2006.01) |
| ***F28B 11/00*** | (2006.01) |
| ***F28F 27/02*** | (2006.01) |
| ***F28F 27/00*** | (2006.01) |
| ***F01K 9/02*** | (2006.01) |
| ***F01K 7/16*** | (2006.01) |

(52) U.S. Cl.
CPC ..... *F01K 9/006* (2013.01); *F01K 9/023* (2013.01); *F28B 1/06* (2013.01); *F28B 11/00* (2013.01); *F28F 27/00* (2013.01); *F28F 27/02* (2013.01)

(58) Field of Classification Search
CPC ..... F01K 9/003; F01K 9/023; F01K 13/02; F28D 1/024; F28D 1/0435
See application file for complete search history.

(56) References Cited

U.S. PATENT DOCUMENTS 4,045,961 A * 9/1977 Schoonman ..... F28B 9/005 165/111
4,449,368 A * 5/1984 Haynie ..... F01K 9/003 60/652
4,518,035 A * 5/1985 Larinoff ..... F28B 1/06 165/101
5,385,202 A * 1/1995 Drosdziok ..... G01K 17/12 165/11.1
6,588,499 B1 * 7/2003 Fahlsing ..... F28B 1/06 165/111
2005/0072155 A1 4/2005 Tsutsui et al.
2010/0199672 A1 * 8/2010 Bellows ..... F01K 9/006 60/660
2011/0066298 A1 * 3/2011 Francino ..... F01K 9/003 700/290
2011/0107775 A1 * 5/2011 Akehurst ..... F25B 49/022 62/89
2014/0318130 A1 * 10/2014 Duong ..... F01K 7/345 60/648

FOREIGN PATENT DOCUMENTS

| | | | |
|---|---|---|---|
| JP | H11-132674 | A | 5/1999 |
| JP | H11-337272 | A | 12/1999 |
| JP | 2003-343211 | A | 12/2003 |
| JP | 2005-140013 | A | 6/2005 |
| JP | 2007-006683 | A | 1/2007 |
| JP | 2007-107814 | A | 4/2007 |
| JP | 2007-139235 | A | 6/2007 |
| JP | 2009-097391 | A | 5/2009 |

* cited by examiner

FIG. 6

| | | OUTSIDE AIR TEMPERATURE | | | |
|---|---|---|---|---|---|
| | | -40°C | -20°C | 0°C | 15°C |
| NUMBER OF OPENED VALVES | "6" | 2.67 | 2.06 | 1.46 | 1.00 |
| | "5" | 2.28 | 1.76 | 1.24 | 0.85 |
| | "4" | 1.66 | 1.29 | 0.91 | 0.62 |
| | "3" | 0.96 | 0.75 | 0.53 | 0.36 |
| | "2" | 0.38 | 0.29 | 0.21 | 0.14 |
| | "1" | 0.07 | 0.06 | 0.04 | 0.03 |

FIG. 7

| | OUTSIDE AIR TEMPERATURE | | | |
|---|---|---|---|---|
| | −40°C | −20°C | 0°C | 15°C |
| AIR VOLUME 100% | 2.7 | 2.1 | 1.5 | 1 |
| AIR VOLUME 20% | 0.8 | 0.6 | 0.4 | 0.3 |

AIR COOLED CONDENSER AND POWER GENERATING APPARATUS PROVIDED WITH THE SAME

TECHNICAL FIELD

The present invention relates to an air cooled condenser for cooling a working medium with air, the working medium flowing through a hermetically-sealed circulating flow path, and a power generating apparatus provided with the same.

BACKGROUND

A power generating apparatus using water as a medium in a cycle is known, the cycle including a step of rotating a turbine with steam generated by heating the water by a heat source, a step of generating electricity with a generator coupled with the turbine, a step of condensing the low-temperature steam discharged from the turbine, and a step of vaporizing the condensed water with the heat source. In the conventional power generating apparatus, the water as the medium is exposed to outside air, and the water is cooled by the cooling effect of the vaporization heat of the water itself.

For example, JP Patent Publication No. 2003-343211 A (hereinafter referred to as PTL 1) discloses a steam condenser system including a steam condenser, an air extractor, a condenser cooler, a circulating water pump for feeding cooling water to the condenser cooler, a motor for the circulating water pump, and a control means for controlling the rotating speed of the circulating water pump so as to adjust the cooling capacity of the condenser cooler.

Additionally, JP Patent Publication No. 2007-107814 A (hereinafter referred to as PTL 2) discloses an air cooled condenser which guides steam discharged from a steam turbine into a wind channel formed in the condenser and condenses the steam by the heat exchange between the steam and air introduced into the wind channel from an air inlet arranged at the condenser. The air cooled condenser includes an intake air cooler arranged at the air inlet of the condenser, a radiator connected to the intake air cooler through a cooling pipe and for circulating a coolant so as to cool the air flowing into the wind channel from the air inlet, and a compressor for condensing the coolant returning to the radiator from the intake air cooler.

Additionally, JP Patent Publication No. 2009-97391 A (hereinafter referred to as PTL 3) discloses a waste heat recovering apparatus including a power recovering device for recovering power via steam generated due to the overheating of a coolant of an engine, a condenser for turning the steam after passing through the power recovering device back to the liquid coolant, a supply pump for supplying the liquid coolant to the engine, and an air discharging means for discharging the air in a circulating system of the coolant. The air discharging means includes an entering air detecting means, a condenser operation suppressing means for operating on the basis of the detection result by the entering air detecting means, and a reserve tank to which air inside the condenser is discharged along with the coolant when the pressure inside the condenser increases. The entering air detecting means includes a pressure sensor, a water temperature sensor, and a calculating means for comparing the saturation vapor pressure corresponding to the water temperature with the pressure in the system measured by the pressure sensor, so as to determine whether or not the air enters.

Additionally, JP Patent Publication No. H11-337272 A (hereinafter referred to as PTL 4) discloses a steam condenser fan controlling system for a steam condenser arranged in generating equipment, such as a waste incinerator. The steam condenser fan controlling system rotates plural steam condenser fans so as to cool the steam. The steam condenser fan controlling system combines a fixed-number-of-fans control method, in which some of the plurality of fans are operated at a rated rotating speed, with a rotating speed control method, in which the remaining number of fans are operated by means of an inverter at a smaller capacity than a rated capacity, as an operation method of the steam condenser fan. The steam condenser fan controlling system selects either one of the both control methods depending on the outlet temperature of the steam condenser.

BRIEF SUMMARY

In the cooling method of directly exposing the water to the outside air as described in PTL 1, the water evaporates, and therefore, it is necessary to supply water. Moreover, scale is generated due to concentration of the water, thus there is a problem that it is necessary to control the water quality.

As a cooling method capable of overcoming the problem, there is developed the air cooled type cooler described in PTL 2. However, in the method as described in PTL 2, the steam as a working medium for generating electricity is cooled with the air cooled by the intake air cooler. In a cooling means for cooling the medium gas of a cooler, when the outside air temperature becomes lower than the boiling point of the working medium at atmospheric pressure, the pressure in a working medium gas flow path becomes a negative pressure relative to the atmospheric pressure. Thus, there is a problem that the air enters from the connecting section of the pipes of the working medium gas flow path and is mixed into the working medium gas flow path.

In addition, when the air enters the working medium gas flow path, the existence of the air as a non-condensable gas increases the pressure in the working medium gas flow path, and the increase in the back pressure of the turbine reduces the output of the turbine.

In addition, in a case where the rotating speed of the fan is fixed, the rotating speed of the fan is set such that the working medium can be condensed at the highest temperature in summer. Therefore, the working medium is cooled excessively in winter. Thus, there is a problem that the output of power generation obtained from the inputted energy in a power station becomes lower, since the air enters into the working medium gas flow path and the back pressure of the turbine increases.

In addition, in the condenser retaining a medium in the sealed system, it is expected that it is necessary to install an entering air removing apparatus and to control the operation of this entering air removing apparatus in order to remove the air entering into the sealed system. However, since the working medium also leaks when removing the air having entered, there is a problem that it is necessary to supply a working medium.

In the waste heat recovering apparatus described in PTL 3, since the air is removed from the coolant after detecting that the air is mixed with the coolant, the output of power generation is reduced while the air accumulates in the coolant.

PTL 4 discloses the fixed-number-of-fans control method and the rotating speed control method, however, PTL 4 fails to disclose prevention of mixing air with a working medium, and has a different technical problem.

The present invention is made in consideration of the above-mentioned problems and an object thereof is to provide an air condenser capable of suppressing mixing air with a working medium, and a power generating apparatus using the air condenser.

According to an aspect of the present invention, there is provided an air cooled condenser including a cooling device. The cooling device includes a heat exchanger for air-cooling a working medium indirectly through a wall, and a first fan for supplying cooling air to the heat exchanger. The air cooled condenser further includes a pressure detector for detecting a pressure value of the working medium at an outlet of the heat exchanger, and a controller for controlling the cooling device such that the pressure value obtained by the pressure detector comes closer to a target value set to be equal to or larger than an atmospheric pressure. According to the above configuration, the pressure in the condenser is maintained to be a positive pressure relative to the atmospheric pressure. Therefore, it is possible to suppress the mixing air with the working medium.

Additionally, the controller reduces a rotating speed of the first fan when the pressure value obtained by the pressure detector is smaller than the target value, and increases the rotating speed of the first fan when the pressure value obtained by the pressure detector is larger than the target value. According to the above configuration, the cooling capacity can be controlled by controlling the rotating speed of the fan. Therefore, it is possible to prevent the working medium from being cooled excessively.

Additionally, the cooling device may include a plurality of the heat exchangers, a branching pipe for branching the working medium into a plurality of working media and for distributing the plurality of working media to inlets of the plurality of heat exchangers, respectively, an aggregating pipe for aggregating the plurality of working media from outlets of the plurality of heat exchangers, respectively, and a plurality of valves arranged at the inlets or the outlets of the plurality of heat exchangers, respectively. The controller may open an increased number of valves of the plurality of valves when the rotating speed of the first fan is higher than an upper limit value, and may open a reduced number of valves of the plurality of valves when the rotating speed of the first fan is lower than a lower limit value.

According to the above configuration, the cooling capacity of the entirety of the air cooled condenser can be controlled by performing open/close control of the valves for distributing the working media to the heat exchangers, respectively, depending on the change of the heat quantity flowing into the condenser.

Additionally, according to another aspect of the present invention, the cooling device further includes a second fan.

The cooling device activates the second fan when the rotating speed of the first fan is higher than the upper limit value, and deactivates the second fan when the rotating speed of the first fan is lower than the lower limit value.

Compared to the conventional configuration which controls the number of operating devices of plural cooling devices, each of the cooling devices including a set of a heat exchanger and a fan, the configuration of the above aspect of the invention performs the open/close control of the valves on a priority basis. If further cooling capacity is necessary, the number of operating fans of the plurality of second fans is controlled. Therefore, it is possible to reduce the opportunity in which the second fans operate and to reduce the power consumption for the fans.

Furthermore, the air cooled condenser may include a plurality of the second fans. The controller may control the number of operating fans of the plurality of second fans.

Additionally, according to another aspect of the present invention, the cooling device in the air cooled condenser may include a flow regulating valve for regulating a flow rate of the working medium at either of an inlet or the outlet of the heat exchanger. The controller may reduce an opening degree of the flow regulating valve when the pressure value obtained by the pressure detector is smaller than the target value, and may increase the opening degree of the flow regulating valve when the pressure detector is larger than the target value.

In addition to a pressure sensor, the pressure detector may include a thermometer for measuring a temperature of the working medium at the outlet of the heat exchanger, and a calculator for calculating the pressure value of the working medium at the outlet of the heat exchanger on the basis of the temperature measured by the thermometer.

Additionally, a power generating apparatus according to the present application includes the above-mentioned air cooled condenser for condensing a working medium, an evaporator for evaporating the working medium by heat of heat source fluid, a turbine rotated by steam of the working medium supplied from the evaporator, the air cooled condenser supplied with the working medium from the turbine, a generator connected with the turbine, and a pump for feeding the working medium from an outlet of the air cooled condenser to an inlet of the evaporator.

According to the above configuration, it is possible to prevent the air from being mixed with the working medium, so as to improve the power generation efficiency.

According to the following embodiments, it is possible to prevent the pressure in the condenser from being a negative pressure relative to the atmospheric pressure, so as to prevent the air from being mixed with the working medium. In addition, by opening the valves on a priority basis when the quantity of the heat inflow into the condenser increases, and by increasing the number of operating fans after all valves are opened, it is possible to reduce the power consumption for the fans.

BRIEF DESCRIPTION OF THE DRAWINGS

FIG. 6 is a diagram illustrating relationships between the outside air temperatures and heat exchange quantities of the entirety of the condenser in cases where the number of the heat exchanger varies from 1 to 6, respectively; and FIG. 7 is a diagram illustrating examples of heat exchange quantities corresponding to different outside air temperatures and different air volumes of a fan (100%, 20%).

DETAILED DESCRIPTION

Hereinafter, examples of a power generating apparatus according to the present invention will be described with reference to the attached drawings. It is noted that the present invention is not at all limited by the following examples and can be embodied in various other forms appropriately modified without changing the spirit of the invention.

First Example

Figure 1:
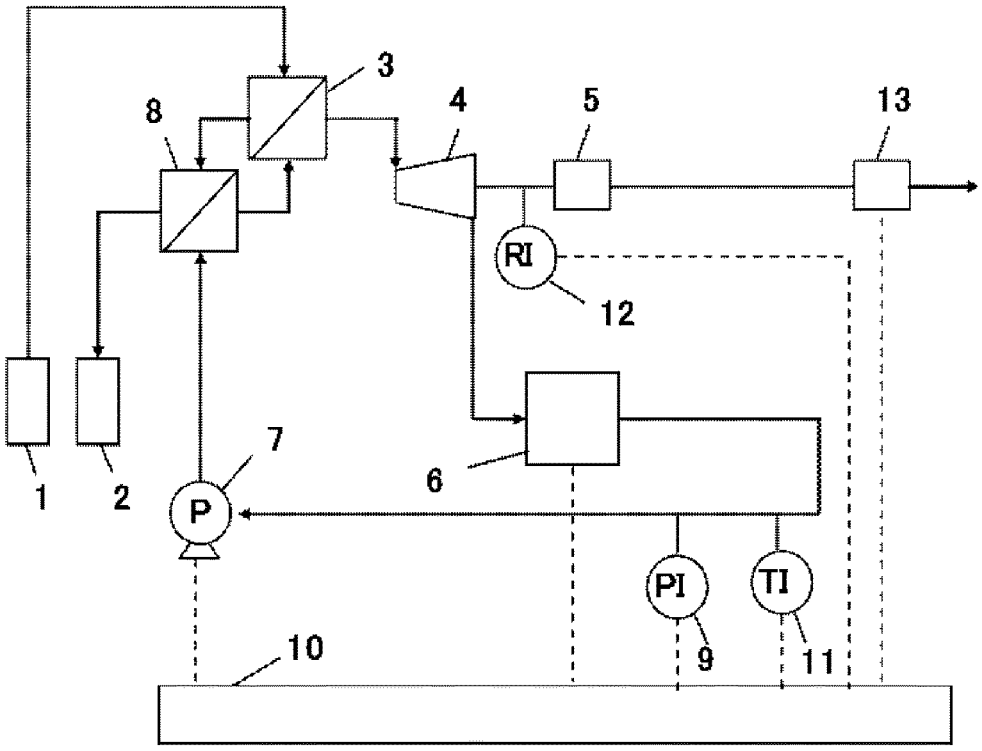
FIG. 1 is a schematic diagram illustrating a configuration of a power generating apparatus with which a condenser according to an example of the present invention is incorporated.

FIG. 1 is a schematic diagram illustrating a configuration of a power generating apparatus with which a condenser according to an example of the present invention is incorporated. Heat source fluid flows from a heat source fluid inlet 1. The heat of the heat source fluid is recovered while the heat source fluid passes through an evaporator 3 and a preheater 8. Then, the heat source is discharged to the outside from a heat source fluid outlet 2. A working medium flows in an annular flow path formed by connecting a circulating pump 7, the preheater 8, the evaporator 3, a turbine 4 and a condenser 6 in this order by means of pipes.

The preheater 8 heats the working medium by heat exchanging between the heat source fluid discharged from the evaporator 3 and the liquid working medium discharged from the condenser 6. It is noted that the preheater 8 is not essential, however, a configuration including the preheater 8 can increase a heat quantity recovered from the heat source fluid.

The evaporator 3 heats the working medium by heat exchanging between the heat source fluid coming from the heat source fluid inlet 1 and the working medium preheated by the preheater 8, so as to gasify the working medium. The gaseous working medium evaporated by the evaporator 3 is supplied to the turbine 4.

The turbine 4 is rotated by the pressure of the gaseous working medium. A rotating shaft of the turbine 4 is coupled with a generator 5, thus power generation is performed by means of the rotation of the turbine 4. A rotating speed meter 12 for measuring the rotating speed of the turbine 4 is installed. The output of the generator 5 is inputted into a power converter 13, and is converted on the basis of an instruction from a controller 10 into direct-current power of a prescribed voltage or alternating-current power of a prescribed voltage and a prescribed frequency, and outputted to the outside. The working medium discharged from the turbine 4 is introduced into the condenser 6.

The condenser 6 is an air cooled type heat exchanger in which the heat exchange is performed between the outside air and the gaseous working medium, and then, the working medium condenses into liquid. As a specific configuration of the condenser 6, for example, a finned tube type heat exchanger having fins arranged around a radiating pipe is preferable. The details of the configuration and the operation of the condenser 6 will be described below.

A pressure gauge 9 is provided at the pipe between the condenser 6 and the circulating pump 7, and a signal line of the pressure gauge 9 is connected with the controller 10.

A thermometer 11 measures the temperature of the working medium at an outlet of the condenser 6. A signal line of the thermometer 11 is connected with the controller 10.

Figure 2:
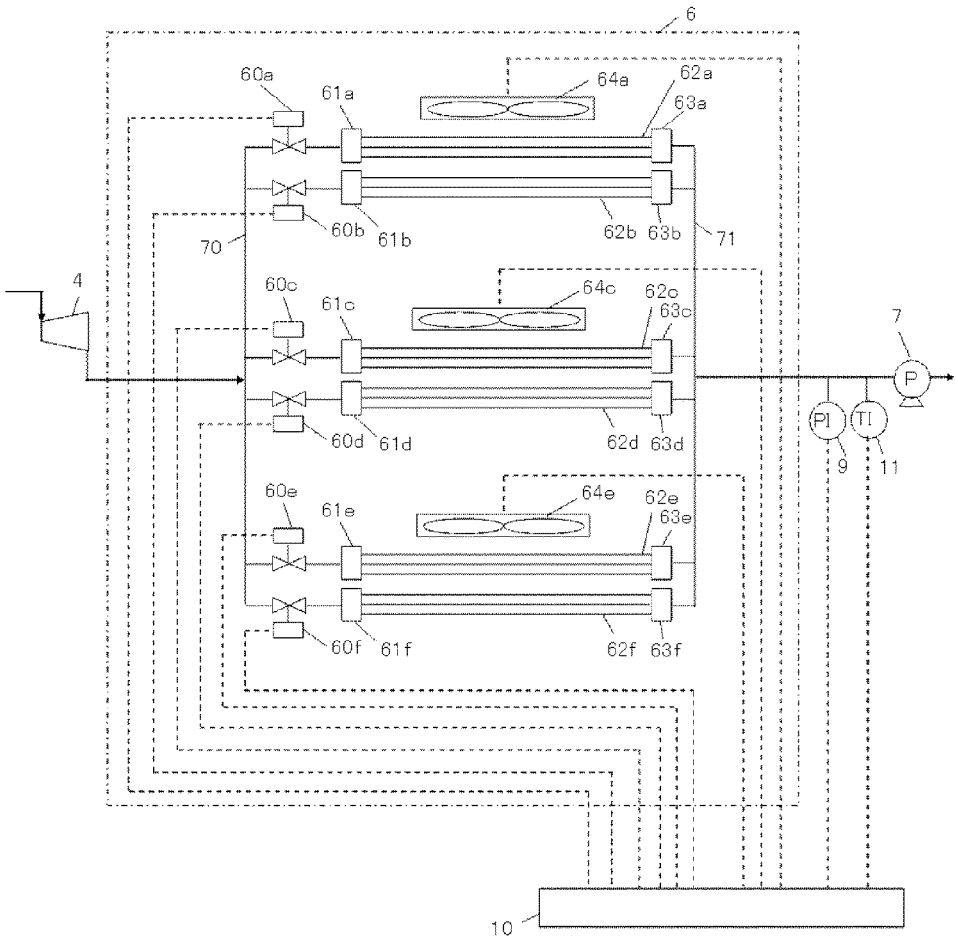
FIG. 2 is a schematic diagram illustrating a configuration of the condenser.

FIG. 2 is a diagram illustrating the condenser 6 and a peripheral portion of the condenser 6 in more detail. A branching pipe 70 branches the gaseous working medium discharged from the turbine 4 into plural working media. The working media flow through valves 60*a*, 60*b*, 60*c*, 60*d*, 60*e*, and 60*f*, inlet manifolds 61*a*, 61*b*, 61*c*, 61*d*, 61*e*, and 61*f*, radiating pipes (heat exchangers) 62*a*, 62*b*, 62*c*, 62*d*, 62*e*, and 62*f*, and outlet manifolds 63*a*, 63*b*, 63*c*, 63*d*, 63*e*, and 63*f*, respectively. When flowing through the radiating pipes 62*a*, 62*b*, 62*c*, 62*d*, 62*e*, and 62*f*, the gaseous working media are cooled with the outside air through pipe walls of the radiating pipes. A first fan 64*a* feeds the outside air to the radiating pipes 62*a* and 62*b* so as to facilitate cooling by the radiating pipes 62*a* and 62*b*. A second fan 64*c* feeds the outside air to the radiating pipes 62*c* and 62*d* so as to facilitate cooling by the radiating pipes 62*c* and 62*d*. A second fan 64*e* feeds the outside air to the radiating pipes 62*e* and 62*f* so as to facilitate cooling by the radiating pipes 62*e* and 62*f*. The liquid working media discharged from the outlet manifolds 63*a*, 63*b*, 63*c*, 63*d*, 63*e*, and 63*f*, respectively, are aggregated by an aggregating pipe 71, and the aggregated working medium is fed to the circulating pump 7. A louver may be installed so as to control the air flow rate of respective fans.

The circulating pump 7 feeds the working media from the condenser 6 to the preheater 8 on the basis of the signal from the controller 10.

The controller 10 is connected with respective signal lines of the valves 60*a*, 60*b*, 60*c*, 60*d*, 60*e*, and 60*f*, a signal line of the pressure gauge 9, a signal line of the thermometer 11, and a power line of the first fan 64*a* and respective power lines of the second fans 64*c* and 64*e*. Then, the controller 10 controls the flow rate of the liquid working medium to be fed to the preheater 8 by the circulating pump 7, on the basis of an instruction value of the flow rate of the working medium fed to the turbine 4.

Next, a relationship between the condenser 6 and the outside air temperature will be described. FIG. 6 is a diagram illustrating relationships between the outside air temperatures and heat exchange quantities of the entirety of the condenser in cases where the number of the heat exchanger varies from 1 to 6, respectively. The heat exchange quantity in a case where the outside air temperature is 15° C. and the air volume of the fan is 100% is normalized as "1.0". When the six valves are opened and the outside air temperature is −40° C., the heat exchange quantity of the condenser is 2.67 times. The quantity of heat transfer of the condenser 6 is expressed in the following formula 1.

$$Q=U\times A\times Tm; \text{ where} \qquad \text{(Formula 1)}$$

Q is a heat exchange quantity (W);
U is an overall heat-transfer coefficient ($W/m^2 \cdot K$);
A is a heat transfer area ($m^2$); and
$T_m$ is a log mean temperature difference (K).

It is noted that the change of U is small, since the air flow rate remarkably influences U and the air flow rate is constant. In addition, the area is constant, and therefore, Q is approximately proportional to the log mean temperature difference. FIG. 6 illustrates the heat exchange quantity corresponding to the change of the outside air calculated based on the relationships. When the working medium is cooled excessively and the saturation vapor pressure of the working medium becomes lower than the atmospheric pressure, the air might be sucked into the condenser since the pressure in the condenser is a negative pressure. Thus, taking into account a case where three valves are opened, the heat exchange quantity of the condenser is 0.96 times even if the outside air temperature is −40° C. Accordingly, by preventing the working medium from being cooled excessively, it is possible to prevent the saturation vapor pressure of the working medium from being lower than the atmospheric pressure.

FIG. 7 is a diagram illustrating examples of heat exchange quantities corresponding to different outside air temperatures and different air volumes of the fan (100%, 20%). The heat exchange quantity in a case where the outside air temperature is 15° C. and the air volume of the fan is 100% is normalized as "1.0". Under the condition where the outside air temperature is −40° C., the heat exchange quantity of the condenser is 0.8 times even if the air volume is reduced to 20%. Therefore, it is possible to prevent the heat exchange quantity from exceeding "1". Accordingly, by preventing the working medium from being cooled excessively, it is possible to prevent the saturation vapor pressure of the working medium from being lower than the atmospheric pressure.

Figure 3:
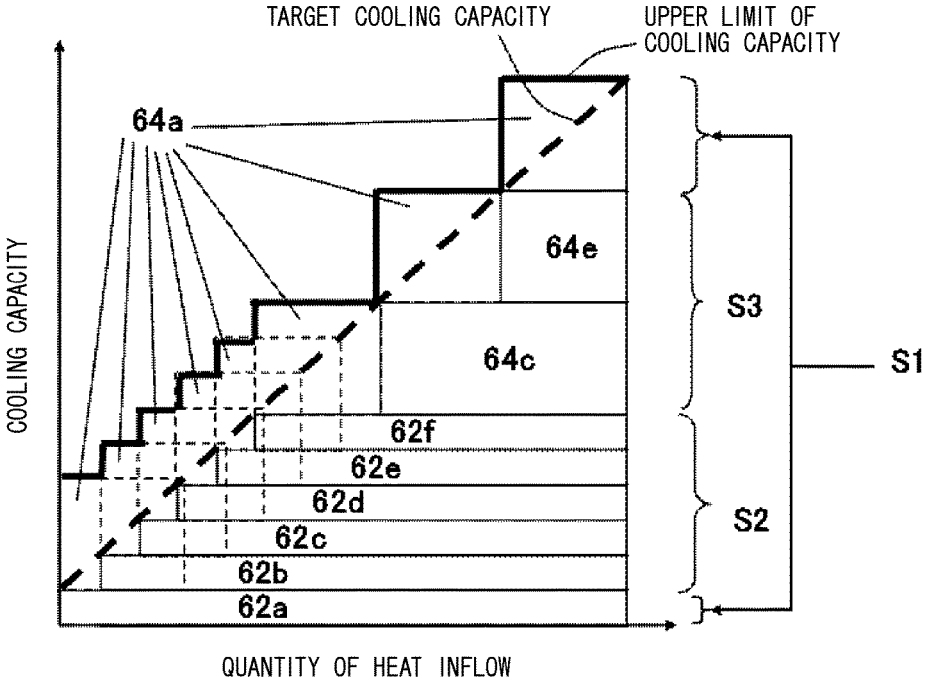
FIG. 3 is a diagram illustrating a combination of operations of valves and fans of the condenser.
Figure 4:
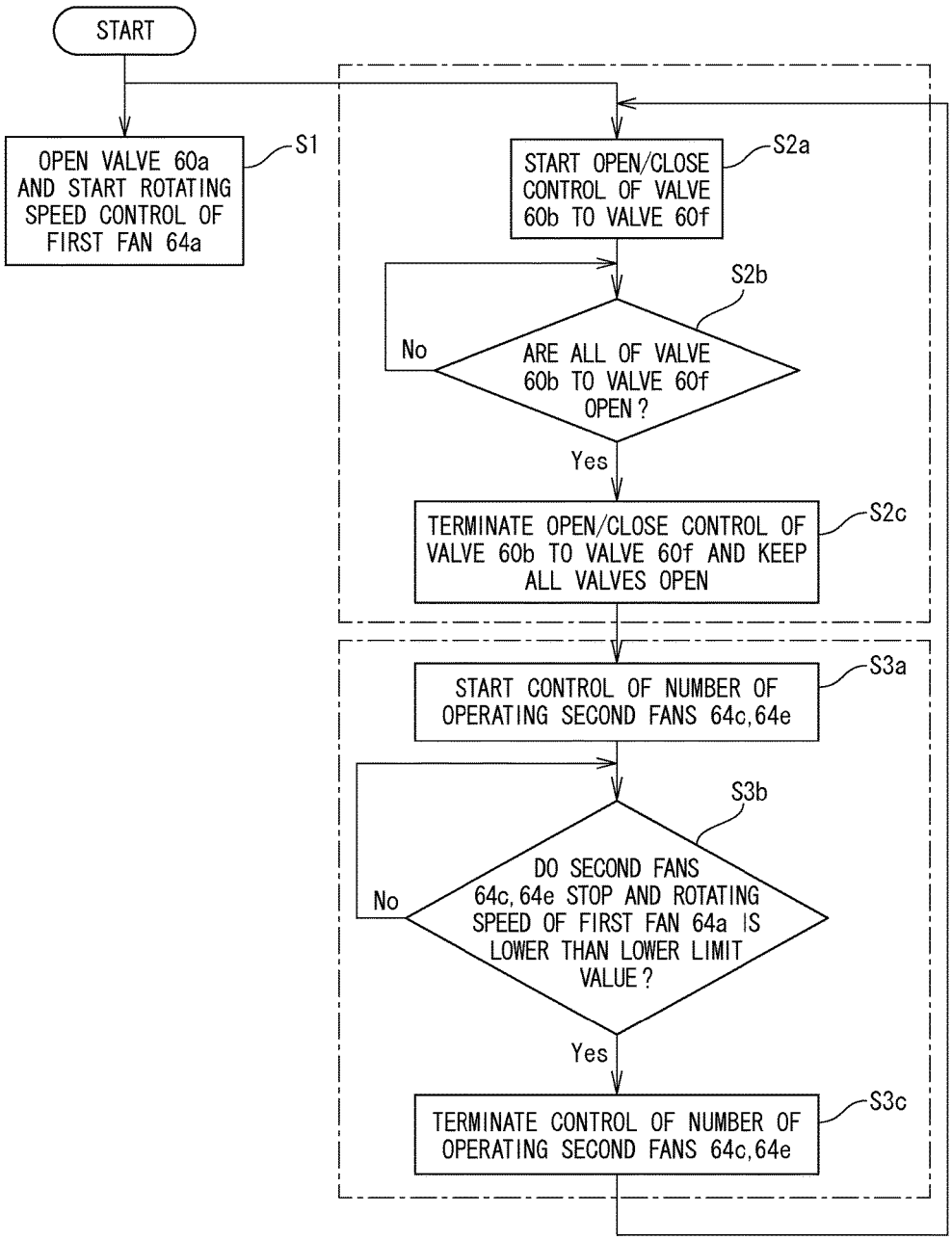
FIG. 4 is a sequence diagram of operation.

Next, the operation of the apparatus will be described. FIG. 3 is a diagram illustrating a combination of operations of the valves and the fans of the condenser 6. FIG. 4 is a sequence diagram of operation.

A summary of the operation of the example of the present invention will be described with reference to FIG. 3. As the quantity of the heat inflow increases, firstly, the valves 60*a*, 60*b*, 60*c*, 60*d*, 60*e*, and 60*f* are opened sequentially so as to increase the cooling capacities of the radiating pipes 62*a*, 62*b*, 62*c*, 62*d*, 62*e*, and 62*f* connecting to these valves, respectively. If the quantity of the heat inflow further increases, the second fans 64*c* and 64*e* are activated sequentially, so as to increase the cooling capacities. In all of these steps, the rotation speed of the first fan 64*a* is controlled. The first fan 64*a* is controlled such that the pressure value measured by the pressure gauge 9 at the outlet of the condenser comes close to a target value.

Next, the operation will be described with reference to FIG. 4 in more detail. The control procedure of the controller 10 roughly includes three steps.

In step S1, firstly, the valve 60*a* illustrated in FIG. 2 is opened, and the rotating speed control of the first fan 64*a* is performed such that the pressure value obtained by the pressure gauge 9 comes closer to the target value regardless of the quantity of the heat inflow. Specifically, the controller 10 reduces the rotating speed of the first fan 64*a* when the pressure value obtained by the pressure gauge 9 is smaller than the target value, and increases the rotating speed of the first fan 64*a* when the pressure value obtained by the pressure gauge 9 is larger than the target value. It is preferred that the above rotating speed control be performed by using Proportional-Integral-Derivative (PID) control.

When the above target value is set to be larger than the atmospheric pressure, it is possible to suppress degradation in power generation efficiency due to air mixed into the condenser 6. However, when the target value is too large, the cooling capacity of the condenser 6 degrades.

Thus, it is preferable to input the measured value of a barometer, not illustrated, provided at the outside of the condenser 6 to the controller 10, and to control by using a value 0 percent to 50 percent larger than the measured value as the target value. According to the above setting of the target value, it is possible to suppress degradation in the output of power generation while the pressure in the condenser 6 is maintained to be larger than the atmospheric pressure.

Furthermore, preferably, the target may be 20 percent larger than the measured value of the barometer. According to the above setting, it is possible to avoid a negative pressure in the system when the temperature of hot water as a high-temperature heat source or the temperature of the outside air as a low-temperature heat source changes.

In parallel with step S1, the controller 10 performs open/close control of the valves 60*b*, 60*c*, 60*d*, 60*e*, and 60*f* other than valve 60*a*, in step S2 where the quantity of the heat flowing into the condenser 6 is relatively small. Step S2 includes substeps S2*a*, S2*b* and S2*c* to perform the open/close control as shown in FIG. 4. Specifically, on the basis of a predetermined priority of opening/closing valves, the controller 10 increases the number of opened valves of 60*b*, 60*c*, 60*d*, 60*e*, and 60*f* when the rotating speed of the first fan 64*a* is higher than an upper limit value, and reduces the number of opened valves of 60*b*, 60*c*, 60*d*, 60*e*, and 60*f* when the rotating speed of the first fan 64*a* is lower than an lower limit value. When all of the valves of 60*b*, 60*c*, 60*d*, 60*e*, and 60*f* are opened, the open/close control of the valves 60*b*, 60*c*, 60*d*, 60*e*, and 60*f* is terminated, the process proceeds to step S3 in a state that the respective valves are opened.

In step S3 after step S2, the controller 10 controls activation/deactivation of the second fans 64*c* and 64*e* so as to control the number of the second fans operating. Step S3 includes substeps S3*a*, S3*b* and S3*c* to perform the activation/deactivation as shown in FIG. 4. Specifically, on the basis of a predetermined priority of activation of the second fans 64*c* and 64*e*, the controller 10 activates at least one of the second fans 64*c* and 64*e* when all of the valves of 60*a*, 60*b*, 60*c*, 60*d*, 60*e*, and 60*f* are opened and the rotating speed of the first fan 64*a* is higher than the upper limit value, and deactivates the at least one of the second fans 64*c* and 64*e* when the rotating speed of the first fan 64*a* is lower than the lower limit value. When all of the second fans 64*c* and 64*e* stop and the rotating speed of the first fan 64*a* is lower than the lower limit value, step S3 is terminated and the process returns to step S2.

The key point of the above example in the light of power consumption reduction is that there is provided with plural heat exchangers for air-cooling a working medium indirectly through a wall, a plurality valves arranged at the plurality of heat exchangers, respectively, plural fans for cooling at least one of the plurality of heat exchangers, a sensor for measuring the pressure value of the working medium at an outlet of one of the plurality of heat exchangers, and a controller for performing open/close control of the plurality of valves such that the pressure value obtained by the sensor comes closer to a target value before activation of two or more of the fans. According to the above configuration, it is possible to reduce the opportunity in which the two or more fans operate, since the open/close control of the valves is performed on a priority basis before activation of the fans. Accordingly, it is possible to reduce the power consumption for the fans.

Figure 5:
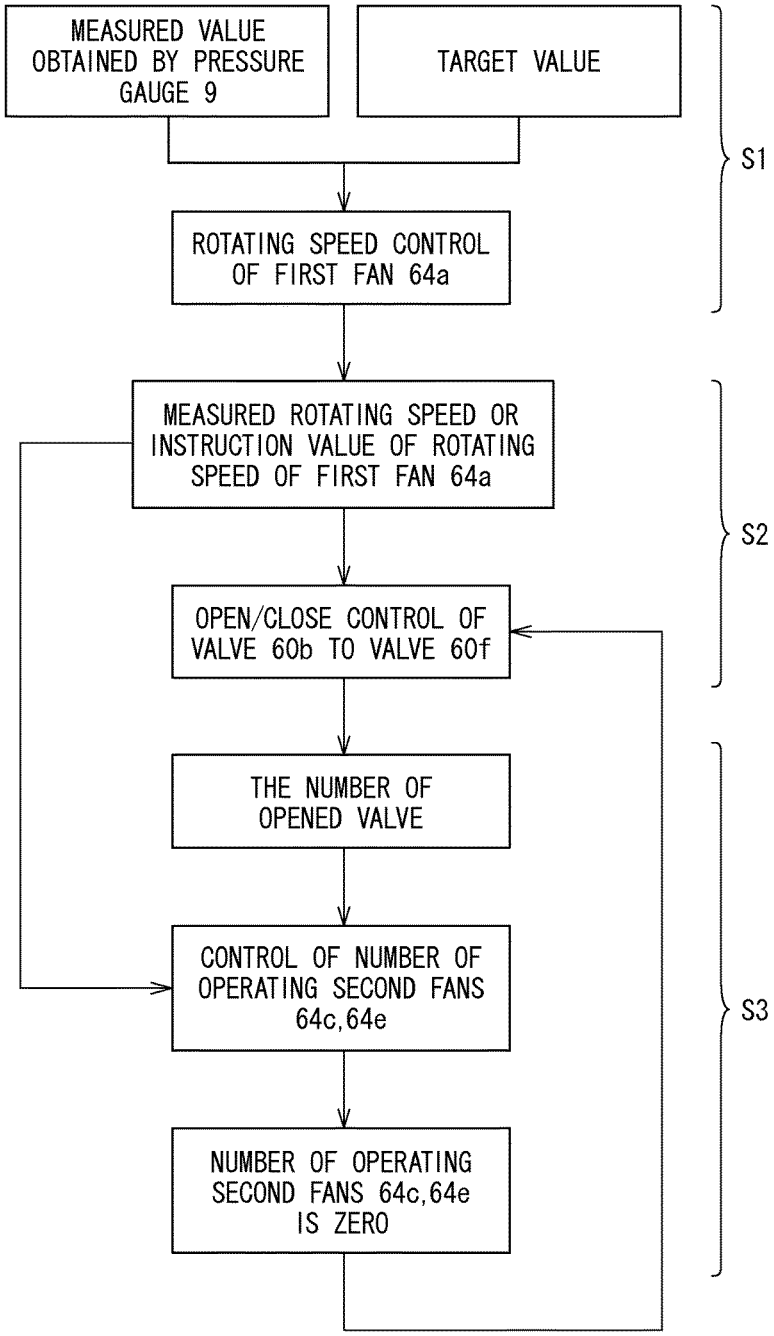
FIG. 5 is a data flow diagram.

Next, the data flow of the present apparatus is illustrated in FIG. 5. The controller 10 performs the rotating speed control of the first fan 64*a* in step S1, on the basis of the measured value obtained by the pressure gauge 9 and the target value.

In addition, the controller 10 monitors the measured rotating speed or the instruction value of the rotating speed of the first fan 64*a*, and performs the open/close control of the valves of 60*a*, 60*b*, 60*c*, 60*d*, 60*e*, and 60*f* in step S2, on the basis of these values.

The controller 10 monitors the measured rotating speed or the instruction value of the rotating speed of the first fan 64*a*, and performs control so as to open the valves when either one of these rotating speeds becomes higher than an upper limit value and to close the valves when either one of these rotating speeds becomes lower than a lower limit value.

The controller 10 monitors the number of opened valves of the valves of 60*a*, 60*b*, 60*c*, 60*d*, 60*e*, and 60*f*. When all of the valves are opened, the controller 10 starts to control the number of operating fans of the second fans. The controller 10 monitors the measured rotating speed or the instruction value of the rotating speed of the first fan 64*a*, and performs control so as to activate at least one of the second fans when either one of these rotating speeds becomes higher than an upper limit value, and to deactivate the at least one of the second fans when either one of these rotating speeds becomes lower that a lower limit value. When the quantity of the heat inflow decreases and then all of the second fans 64*c* and 64*e* stop and the rotating speed of the first fan 64*a* becomes lower than the lower limit value, step S3 is terminated and the process returned to the open/close control of the valves in step S2.

Second Example

The following configuration may be adopted as a modification example of the above first example. With regard to the open/close control of the valves of 60*a*, 60*b*, 60*c*, 60*d*, 60*e*, and 60*f* in the above first example, the respective valves may be flow regulating valves, and the flow rates of the working media flowing through the heat exchangers, respectively, may be controlled. In such a configuration, the priority between the valves corresponding to the increase of the quantity of the heat inflow is predetermined. The controller 10 performs control such that, after the opening degree of the valve with relatively high priority becomes 100%, the valve with next priority starts to open. Furthermore, the controller 10 reduces the opening degree of the flow regulating valves when the pressure value obtained by the pressure gauge 9 is smaller than the target value, and increases the opening degree of the flow regulating valves when the pressure value obtained by the pressure gauge 9 is larger than the target value.

Third Example

The following configuration may be adopted as a modification example of the above first example or the above second example. The thermometer 11 for measuring the working medium at the outlet of the heat exchanger may be used instead of measuring the pressure at the outlet of the condenser 6 by the pressure gauge 9. The controller 10 may calculate the pressure value of the working medium at the outlet of the heat exchanger on the basis of the temperature measured by the thermometer 11, and may perform the similar control as that of the above first example or the above second example. Specifically, in the case of normal pentane, for example, the saturation vapor pressure value (Pst) at a temperature (T1) is calculated by using the following formula 2. When a different medium is used as a working medium, the calculation formula of the saturation vapor pressure value (Pst) may be modified accordingly depending on the characteristic of the working medium.

$$Pst=0.0003(T1)^3+0.0159(T1)^2+1.1844(T1)+24.316 \quad \text{(Formula 2)}$$

As discussed above, according to the examples of the present invention, when the target value is set to be equal to or larger than the atmospheric pressure, it is possible to prevent the pressure in the condenser from being a negative pressure relative to the atmospheric pressure, so as to prevent the air from being mixed with the working medium.

The invention claimed is:

1. An air cooled condenser comprising:

a cooling device including:

a plurality of heat exchangers for air-cooling a working medium, the plurality of heat exchangers comprising:

a first heat exchanger for air-cooling the working medium indirectly through a first wall; and a second heat exchanger for air-cooling the working medium indirectly through a second wall, the second heat exchanger being different from the first heat exchanger;

a first fan for supplying cooling air only to the first heat exchanger of the plurality of heat exchangers;

a second fan for supplying cooling air only to the second heat exchanger of the plurality of heat exchangers;

a pressure detector for detecting a pressure value of the working medium at an outlet of at least one of the first heat exchanger or the second heat exchanger; and a controller configured to control the cooling device such that the pressure value obtained by the pressure detector comes closer to a target value set to be equal to or larger than an atmospheric pressure, wherein:

the controller reduces a rotating speed of the first fan when the pressure value obtained by the pressure detector is smaller than the target value, and increases the rotating speed of the first fan when the pressure value obtained by the pressure detector is larger than the target value;

the cooling device includes:

a branching pipe for branching the working medium into a plurality of working media and for distributing the plurality of working media to inlets of the first and second heat exchangers, respectively;

an aggregating pipe for aggregating the plurality of working media from outlets of the first and second heat exchangers, respectively; and a plurality of valves arranged at the inlets or the outlets of the first and second heat exchangers, respectively, the controller opens an increased number of valves of the plurality of valves when the rotating speed of the first fan is higher than an upper limit value, and opens a reduced number of valves of the plurality of valves when the rotating speed of the first fan is lower than a lower limit value, and the controller determines whether or not the rotating speed of the first fan is higher than the upper limit value and all of the plurality of valves are opened, and activates the second fan when it is determined that the rotating speed of the first fan is higher than the upper limit value and all of the plurality of valves are opened, and deactivates the second fan when it is determined that the rotating speed of the first fan is lower than the lower limit value.

2. The air cooled condenser according to claim 1, further comprising:

a third heat exchanger of the plurality of heat exchangers for air-cooling the working medium indirectly through a third wall; and a third fan for supplying cooling air to the third heat exchanger, wherein the controller controls the number of operating fans of the second and third fans.

3. A power generating apparatus comprising:

the air cooled condenser according to claim 2, for condensing a working medium;

an evaporator for evaporating the working medium by heat of heat source fluid;

a turbine rotated by steam of the working medium supplied from the evaporator, the air cooled condenser supplied with the working medium from the turbine;

a generator connected with the turbine; and a pump for feeding the working medium from an outlet of the air cooled condenser to an inlet of the evaporator.

4. The air cooled condenser according to claim 2, wherein the pressure detector includes:

a thermometer for measuring a temperature of the working medium at the outlet of the at least one of the first heat exchanger or the second heat exchanger; and a calculator for calculating the pressure value of the working medium at the outlet of the at least one of the first heat exchanger or the second heat exchanger on the basis of the temperature measured by the thermometer.

5. The air cooled condenser according to claim 1, wherein:

each of the plurality of valves is a flow regulating valve for regulating a flow rate of the working medium; and the controller reduces an opening degree of the flow regulating valve when the pressure value obtained by the pressure detector is smaller than the target value, and increases the opening degree of the flow regulating valve when the pressure detector is larger than the target value.

6. The air cooled condenser according to claim 1, wherein the pressure detector includes:

a thermometer for measuring a temperature of the working medium at the outlet of the at least one of the first heat exchanger or the second heat exchanger; and a calculator for calculating the pressure value of the working medium at the outlet of the at least one of the first heat exchanger or the second heat exchanger on the basis of the temperature measured by the thermometer.

7. A power generating apparatus comprising:

the air cooled condenser according to claim 1, for condensing a working medium;

an evaporator for evaporating the working medium by heat of heat source fluid;

a turbine rotated by steam of the working medium supplied from the evaporator, the air cooled condenser supplied with the working medium from the turbine;

a generator connected with the turbine; and a pump for feeding the working medium from an outlet of the air cooled condenser to an inlet of the evaporator.

* * * * *